United States Patent [19]

Chiba

[11] 3,932,944

[45] Jan. 20, 1976

[54] METHOD AND APPARATUS FOR PREVENTING WATERDROPS INSIDE A SEALED INSTRUMENT

[76] Inventor: Mitsumasa Chiba, c/o Choshichi Ishida, Mainichi Sangyo Bldg., 39, 2-chome, Dojima Kami, Kita, Osaka, Japan

[22] Filed: Sept. 12, 1974

[21] Appl. No.: 505,320

[52] U.S. Cl. ..... 34/12; 34/15; 34/92; 34/104; 58/1 R

[51] Int. Cl.[2] ..... F26B 7/00; F26B 5/04

[58] Field of Search ..... 34/12, 15, 92, 104; 58/1 R

[56] References Cited

UNITED STATES PATENTS

| | | | |
|---|---|---|---|
| 2,854,815 | 10/1958 | Piquerez | 58/1 R |
| 3,088,219 | 5/1963 | Kraus | 34/15 |
| 3,262,212 | 7/1966 | De Buhr | 34/15 X |
| 3,451,189 | 6/1969 | Taggart | 34/92 |

*Primary Examiner*—John J. Camby
*Attorney, Agent, or Firm*—George B. Oujevolk

[57] ABSTRACT

An arrangement for preventing the production of waterdrops inside a wrist watch, comprising a hollow sealed container communicating with a suction pipe having an on-off valve for a suction pump on one side and an air feed section having an on-off valve, a desiccator and a filtering material on the other side. A watch is placed in the container with the crystal of the watch loosened. Air in the container is withdrawn by the pump to decrease the pressure therein, whereupon dry air, which has been passed through a desiccator and filtering material, is suctioned into the sealed container and enters the wrist watch therein, so that dry air is thus enclosed in the watch.

2 Claims, 6 Drawing Figures

METHOD AND APPARATUS FOR PREVENTING WATERDROPS INSIDE A SEALED INSTRUMENT

BACKGROUND OF THE INVENTION

The present invention relates to an arrangement for preventing the production of waterdrops or moisture in small instruments, such as wrist watches, which clouds the watch crystal so that the instrument dial cannot be readily viewed.

THE PROBLEM

Conventionally, when the watch crystal of a wrist watch, stop watch, or similar instrument, is opened for repair of other purposes, moisture often enters the watch. When moisture, whose temperature has been raised by the wearer's body temperature, is rapidly cooled, as by cold air or cold water, it forms waterdrops adhering to the inner surface of the watch crystal clouding the dial to render the information on the dial difficult to read or causes failure of the instrument by rusting of the movement.

SUMMARY OF THE INVENTION

The present invention contemplates enclosing dry air free from moisture in a watch or other similar instrument by placing the watch in a sealed container communicationg on one side with a suction pipe having an on-off valve for a suction pump and on the other side with an air feed section having an on-off valve, a desiccator and a filtering material. The watch is placed in the sealed container with the crystal of the watch loosened. Air in the container is withdrawn by the pump to decrease the pressure therein, wherupon dry air which has been passed through the desiccator and filtering material is suctioned into the sealed container and enters the sealed watch or instrument so that dry air is thus enclosed in the sealed watch. The apparatus herein contemplated makes use of a thick plate having a recess formed on the outer surface thereof, said recess being provided with a vacuum suction port and a dry air inlet port. The vacuum suction port is connected to a vacuum pump through a check valve, the dry air inlet portion being connected to an air desiccator through an on-off valve. An annular abutment is formed of a packing material along the outer periphery of the recess and there is a transparent plate such as acrylic resin or glass plate placed on said annular abutment to seal the opening in the recess.

The invention, as well as other objects and advantages thereof, will be more readily apparent from the following detailed description and the accompanying drawing in which:

DETAILED DESCRIPTION

Figure 1:
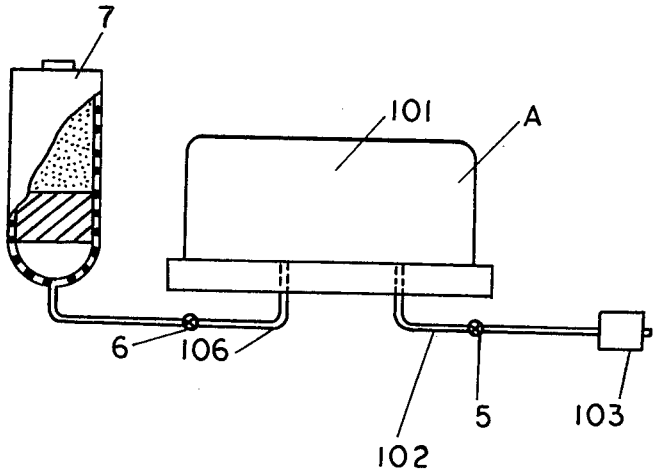
FIG. 1 is a schematic explanation of the inventive concept.
Figure 2A:
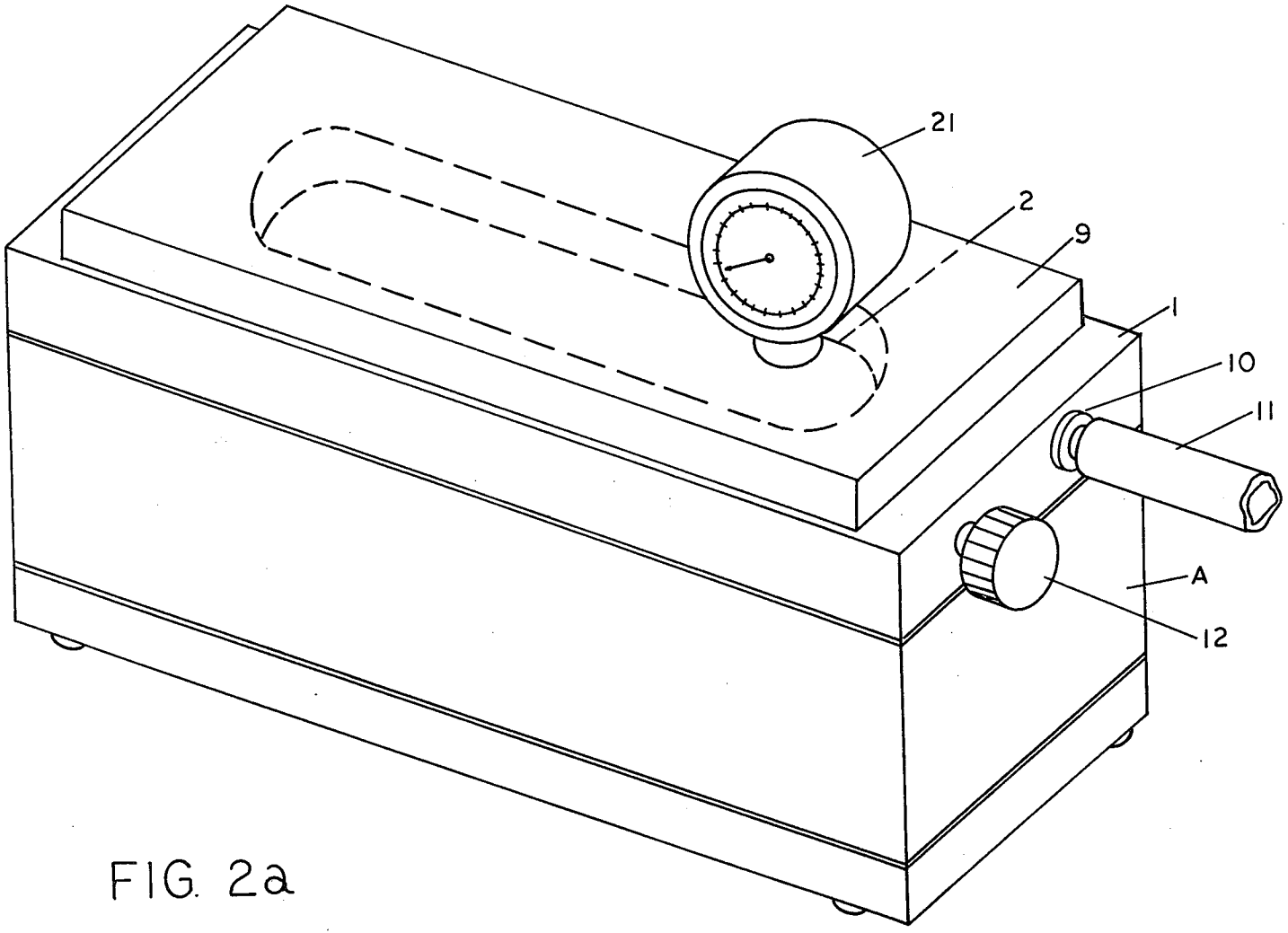
FIG. 2*a* is a persepctive view of the apparatus herein contemplated.
Figure 2B:
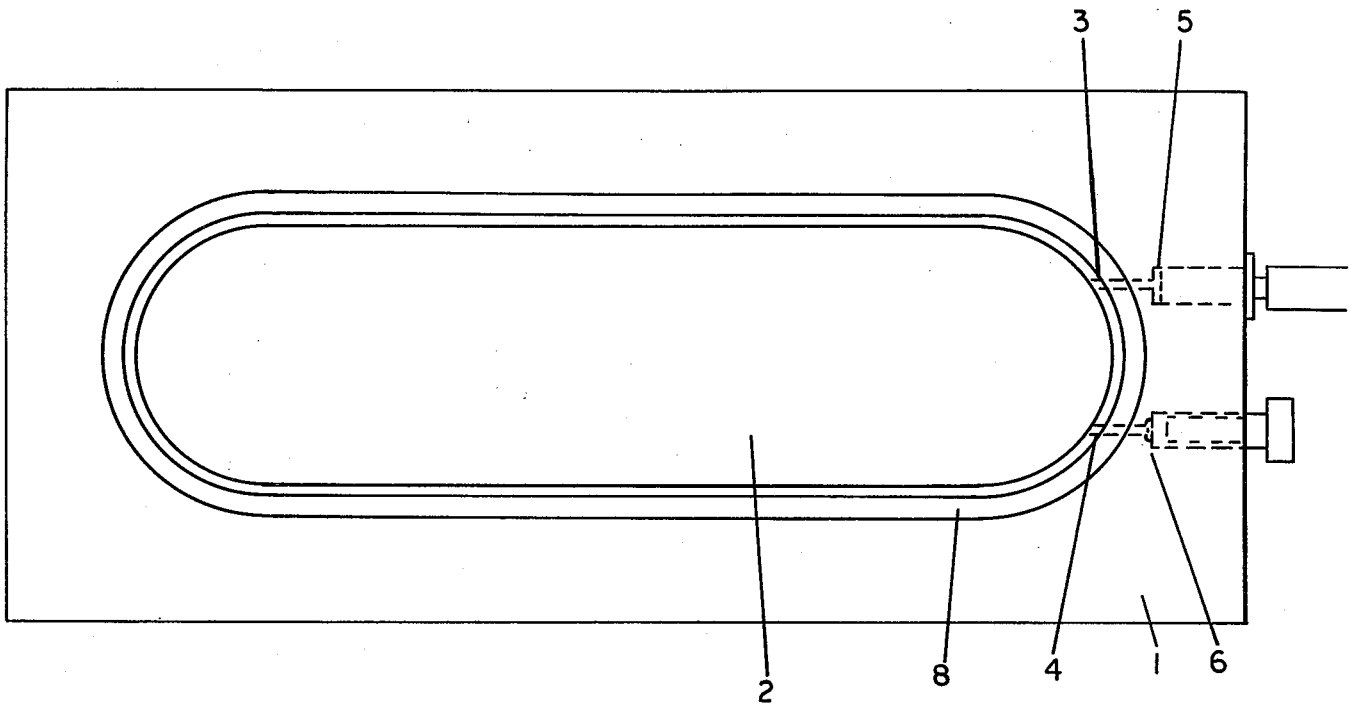
FIG. 2*b* is a top view of the apparatus shown in FIG. 1.

According to the inventive concept, a repaired watch is placed in a sealed container 101, with the watch crystal loosened. First, the humid air in the sealed container is suctioned off through a suction pipe 102 communicating with the container by a suction pump 103 decreasing the pressure therein. Then an on-off valve 6 in an air feed pipe 106 is opened. The air feed pipe 106 connects with a desiccator 7 and filtering material to admit dry air into the sealed container because of the decreased pressure. The dry air penetrates into the watch and prevents future moisture. The apparatus for carrying out this method, comprises a sealed container A communicating with a suction pipe 102 having an on-off vlave 5 for a pump 103 and an air feed pipe 106 having an on-off valve 6 and provided with a desiccator 7 and a filtering material.

Figure 3:
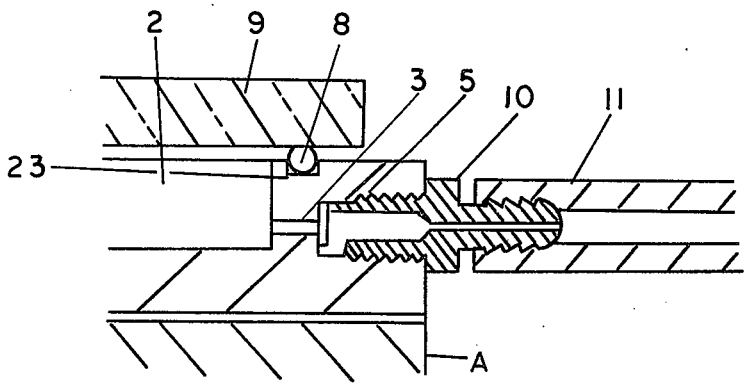
FIG. 3 is a fragmentary sectional view of the air suction section.
Figure 4:
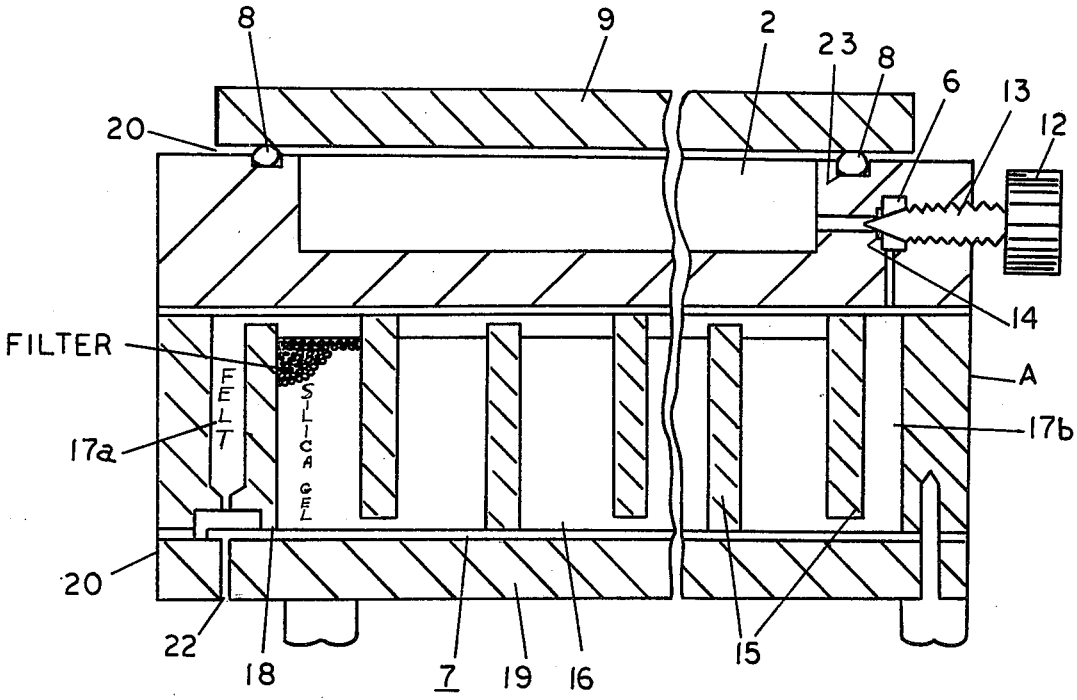
FIG. 4 is a fragmentary sectional view of the apparatus.
Figure 5:
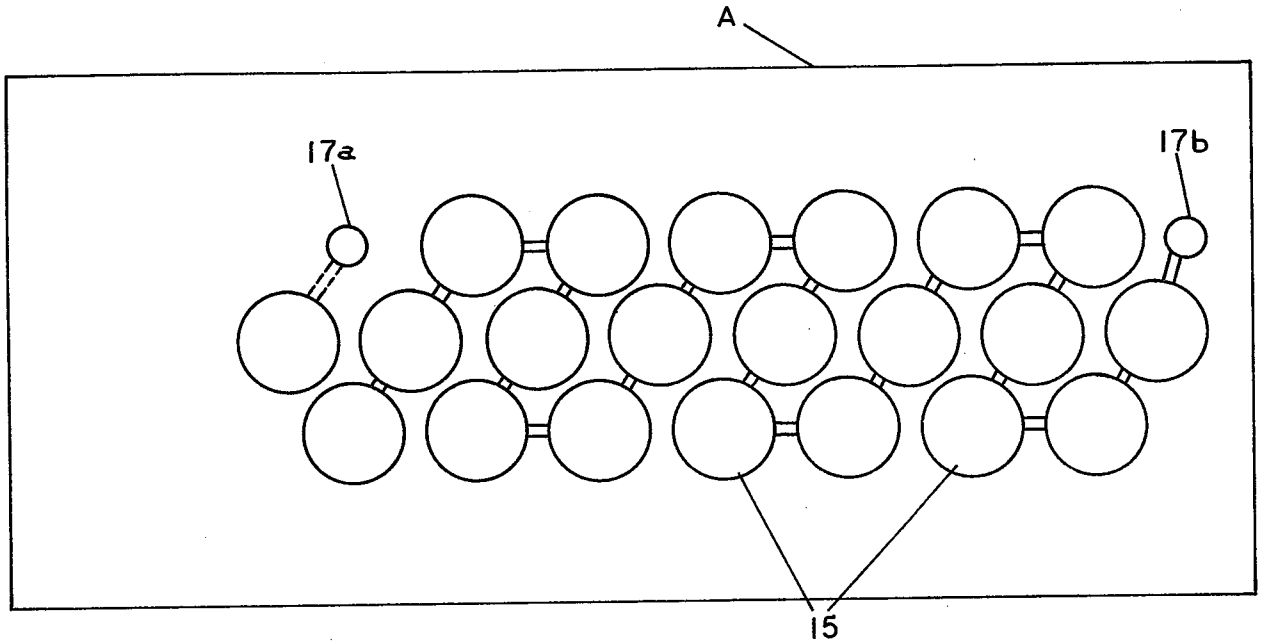
FIG. 5 is an explanatory view showing the arrangement of an air desiccator.

In operation, the on-off valve 6 of the air feed pipe is first closed. The on-off valve 5 of the suction pump is opened and pump is started to suction off humid air in the sealed container to decrease the pressure therein, whereupon the on-off valve 5 is closed and dry air which has been passed through the desiccator and filtering material is suctioned in through on-off valve 6 by making use of the decreased pressure. The dry air is thus enclosed in the watch. The apparatus for enclosing the dry air in the sealed precision instrument such as a watch, comprises a thick plate 1 having a recess 2 formed on the outer surface thereof, said recess being provided with a vacuum suction port 3 and a dry air inlet port 4. The vacuum suction port 3 is connected to the vacuum pump 103 through a check valve 5, said dry air inlet port 4 being connected to an air desiccator 7 through an on-off valve 6. There is an annular abutment 8 formed of a packing material along the outer periphery of the recess, and a transparent plate 9 such as acrylic resin or glass plate is placed on said annular abutment 8 to seal the opening in the recess 2. Thus, the apparatus body A has a thick plate 1 mounted on the upper surface thereof. The upper surface of the plate 1 is formed with an ellipsoidal recess 2. The recess 2 is provided with a vacuum suction port 3 and a dry air inlet port 4. As shown in FIG. 3, the vacuum suction port 3 communicates with the internal chamber through a check valve 5 formed of a rubber-like elastic material and has a hose coupling 10 for a hose 11. A hose 11 is connected to a vacuum pump. The dry air inlet port 4, as shown in FIG. 4, communicates with an air desiccator 7 in the interior of the apparatus body A through an on-off valve 6, which comprises a valve seat 14 and a valve stem 13 adapted to be advanced and retracted by the rotation of a knob 12. The desiccator 7 comprises a number of cylindrical containers 15 standing erect side by side and containing a desiccating agent 16 such as silica gel, said cylindrical containers communicating with each other at their tops and bottoms and arranged in a rectangular waveform as shown in FIG. 4, so that all the desiccating agent functions effectively. When seen from bottom, these cylindrical containers 15 are arranged in the manner shown in FIG. 5. Indicated at 17*a* and 17*b* are air filter sections filled with a dust removing material such as felt. At the inlet to the air filter section 17*a*, a oneway valve 20 is formed by making use of a rubber membrane 18 which is laid as a sealing apparatus body A, thereby preventing dust and water vapor from entering the desiccator 7 when the apparatus is not in use.

The outer peripheral portion of the plate 1 around the recess 2 is formed with an annular groove 23 in which a rubber packing is fitted, thereby forming an annular abutment 8. A transparent plate 9, which covers the opening in the recess 2 is formed of acrylic resin or glass plate. The apparatus also has an air pressure gauge 21 having a measurement opening in the lower side thereof.

OPERATION OF THE INVENTION

When it is desired to enclose dry air, for example, in a wrist watch which has been repaired, first of all, the transparent plate 9 is removed and, with the back lid or front lid of the wrist watch loosened to establish communication between the interior and exterior thereof, the wrist watch is put in the recess 2, whereupon the transparent plate 9 is placed on the annular abutment 8 to seal the opening in the recess 2, whereupon the transparent plate 9 is placed on the annular abutment 8 to seal the opening in the recess 2. The knob 12 is then turned clockwise to see that valve 6 is closed, whereupon the vacuum pump is operated to suction the air in the recess 2. The pressure in the recess 2 is read with the pressure gauge and when the pressure has been decreased to the extent that there is no water vapor therein, the operation of the vacuum pump is stopped. The knob 12 is turned again but in a counterclockwise direction so as to slightly open the on-off valve 14, whereupon atmospheric pressure causes the air to enter the recess 2 through an opening 22 in the bottom plate 9 of the apparatus body A, oneway valve 20, air filter section 17*a*, cylindrical containers 15 and air filter section 17*b*. In this connection, it is to be noted that the air which has entered the recess has been dried by the action of the desiccating agent 16 to the extent that it contains almost no moisture. Such dry air also enters the interior of the wrist watch evacuated to a sub-vacuum state, so that the interior of the wrist which is filled with dry air. After the recess 2 resumes atmospheric pressure, the transparent plate 9 is removed to take out the wrist watch and the loosened lid thereof is tightened to complete the dry air sealing operation.

Although the wrist watch is taken out into the atmosphere with its lid loosened, the dry air contained in the wrist watch will hardly change places with the ambient air since the pressure in the wrist watch is equal to atmospheric pressure. The wrist watch having dry air thus enclosed therein has no longer the disadvantage of the watch crystal becoming clouded and making it difficult to read the figures on the dial plate. Moreover, there is no possibility of the movement being rusted due to moisture. Further, the apparatus is also capable of removing clouds on a wrist watch with waterdrops formed on the crystal.

In addition, instead of the air desiccator 7, an inert gas cylinder, such as an argon or nitrogen cylinder, may be connected to the inlet to the on-off valve 6. This is effective to prevent oxidation of lubricants as well as rusting.

As has been described so far, according to the present invention, a sealed precision device can be filled with dry air to ensure the substantial absence of moisture in the interior of the device, thereby preventing the formation of waterdrops and rust and increasing the durability of the sealed precision device. Further, since an annular abutment is formed of a packing material on the outer periphery of the thick plate around the recess so as to cooperate with a transparent plate placed on said annular abutment to close the opening in the recess, reception and withdrawal of a sealed precision device can be carried out extremely easily by simply mounting said transparent plate on the thick plate and dismounting the same therefrom. Further, since the vacuum suction port at the recess is connected to a vacuum pump through a check valve, in order to suction the air in the recess it is only necessary to operate the vacuum pump and the on-off valve which controls the dry air inlet port. Since the recess is formed on the upper surface is formed on the upper surface of the thick plate, the sealing of the inner wall and bottom surface of the recess is perfect and manufacture is very simple. A further outstanding merit is that the transparent plate allows the operator to observe the condition of sealed precision device in the recess during the dry air cycle of operation.

I claim:

1. A method of preventing the formation of moisture in a watch having a detachable air-tight cover comprising the steps of placing the watch with its cover loosened in a sealed zone; evacuating the air from said zone to cause a vacuum therein then feeding in dry air therein, whereby the dry air penetrates the watch and even when the zone is opened and the cover tightened, the dry air remains in the watch preventing the future foundation of moisture therein.

2. An apparatus for providing a protective dry air in a watch to prevent the formation of moisture in the watch comprising in combination:

a. a box-like housing having a deep lower chamber with a top and bottom defined therein, an elongated shallow recess upper chamber (2) with an upper peripheral abutment (8) formed of packing material around said recess upper chamber, a transparent plate (9) resting on said packing material covering said recess and sealed by said packing material, and first and second ports (4, 3) to said upper chamber;

b. a plurality of vertical cylindrical containers (15) including a first and a last container in said lower chamber, each container being linked to another container alternately towards the top and bottom of said chamber so as to define an elongated gas travel path in said lower chamber, said containers each being filled with a silcia gel desiccator; an air filter (17*a*) connected to said first container, an aperture (22) and a one-way valve (20) into said lower chamber connecting to said air filter (17*a*) said last container being connected to said first port (4);

c. a threaded first valve (6) with a knob (12) connected to said first port (4) to control the dry air flow into said recess upper chamber (2), and a second valve (5) connected to said second port (4);

d. a suction outlet connection connected to said second port (3) for connection to vacuum exhaust means and pump means (103) to exhaust air from said recess upper chamber whereby when a watch with a loosened cover is placed in said chamber, said first valve (6) is closed, said second valve means (5) is opened and pump means (103) exhausts air from the chamber and from the watch, then, when said second valve means is closed and said first valve means (6) is opened, dry air from said lower chamber flows into the recess upper chamber into said watch remaining therein even when said chamber is opened to allow tightening of the watch cover.

* * * * *